US007941084B2

(12) United States Patent
Li et al.

(10) Patent No.: US 7,941,084 B2
(45) Date of Patent: May 10, 2011

(54) APPARATUSES USEFUL FOR PRINTING AND METHODS OF MITIGATING EDGE WEAR EFFECTS IN APPARATUSES USEFUL FOR PRINTING

(75) Inventors: Faming Li, Penfield, NY (US); Eric Scott Hamby, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 108 days.

(21) Appl. No.: 12/463,611

(22) Filed: May 11, 2009

(65) Prior Publication Data

US 2010/0284713 A1 Nov. 11, 2010

(51) Int. Cl.
*G03G 15/20* (2006.01)

(52) U.S. Cl. ..... 399/328; 399/68; 399/322

(58) Field of Classification Search ..... 399/67, 399/68, 320, 322, 328, 329
See application file for complete search history.

(56) References Cited

U.S. PATENT DOCUMENTS

| | | | | |
|---|---|---|---|---|
| 3,856,462 | A * | 12/1974 | Mueller | 432/60 |
| 5,241,348 | A * | 8/1993 | Garavuso et al. | 399/322 |
| 6,246,858 | B1 * | 6/2001 | Condello et al. | 399/329 |
| 7,013,107 | B2 | 3/2006 | Russel et al. | |
| 7,596,334 | B2 * | 9/2009 | Yoshino et al. | 399/67 |
| 7,706,722 | B2 * | 4/2010 | Hildebrand et al. | 399/162 |
| 2008/0145115 | A1 | 6/2008 | Spence et al. | |

* cited by examiner

*Primary Examiner* — Sandra L Brase
(74) *Attorney, Agent, or Firm* — Ronald E. Prass, Jr.; Prass LLP

(57) ABSTRACT

Apparatuses useful for printing and methods of mitigating media edge wear effects in apparatuses useful for printing are provided. An exemplary apparatus useful for printing includes a first roll including a first outer surface; a second member including a conformable second outer surface forming a nip with the first outer surface; and a registration distribution system including a motor for translating at least the second member, relative to a medium passing through the nip, in at least a first zig-zag motion pattern from a first home position to a second home position.

22 Claims, 8 Drawing Sheets

APPARATUSES USEFUL FOR PRINTING AND METHODS OF MITIGATING EDGE WEAR EFFECTS IN APPARATUSES USEFUL FOR PRINTING

BACKGROUND

Some printing apparatuses include a nip formed by a roll and second member, such as a second roll. In such apparatuses, media are fed to the nip and contacted by the roll and second member to treat marking material on the media to form prints. In such apparatuses, edges of the media can cause edge wear of the second member. Such edge wear can reduce image quality and reduce the life of the second member.

It would be desirable to provide apparatuses useful for printing that can mitigate edge wear of members that contact media.

SUMMARY

Apparatuses useful for printing and methods of mitigating edge wear effects in apparatuses useful for printing are provided. An exemplary embodiment of an apparatus useful for printing comprises a first roll including a first outer surface; a second member including a conformable second outer surface forming a nip with the first outer surface; and a registration distribution system including a motor for translating at least the second member, relative to a medium passing through the nip, in at least a first zig-zag motion pattern from a first home position to a second home position.

DRAWINGS

Figure 7:
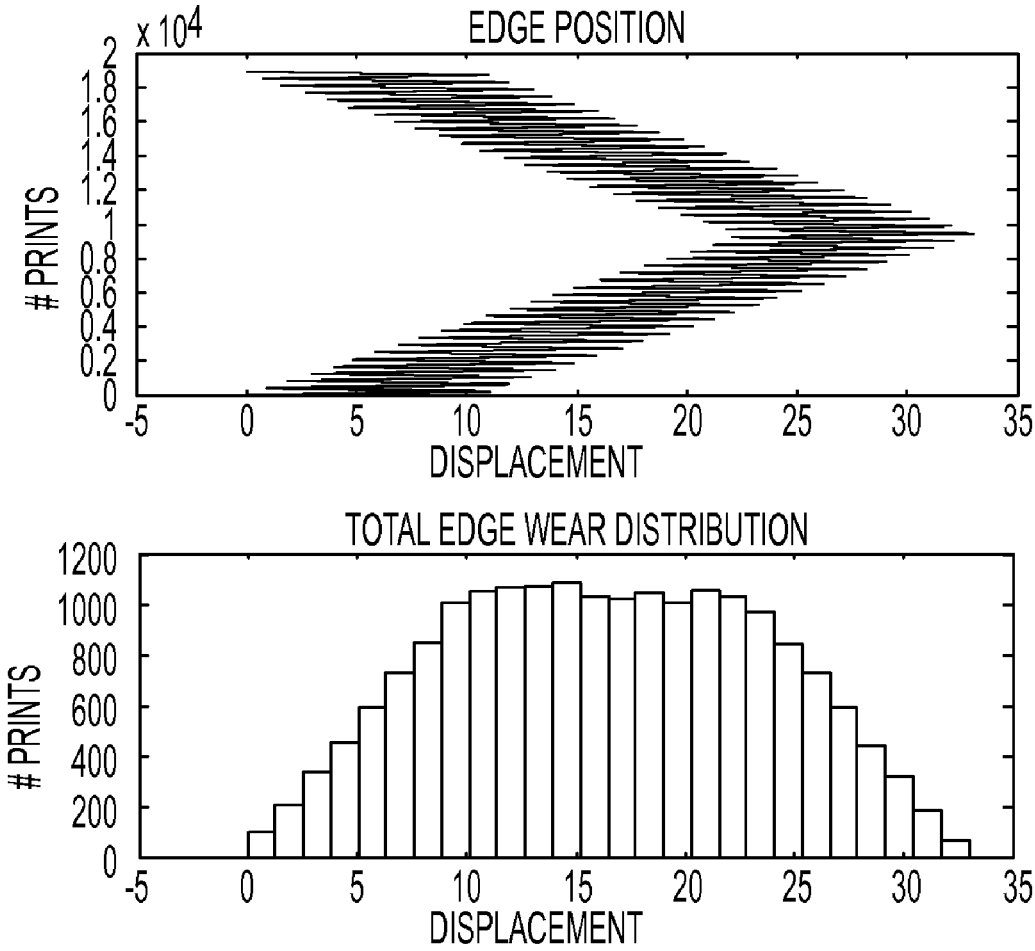

FIG. 7 depicts an exemplary relationship between roll displacement in the axial direction of a roll and print number and edge pattern, respectively, using a zig-zag motion pattern for moving the roll in an apparatus including a registration distribution system (top curve), and between roll displacement in the axial direction and print number and total edge wear distribution, respectively, (bottom curve).

Figure 8:
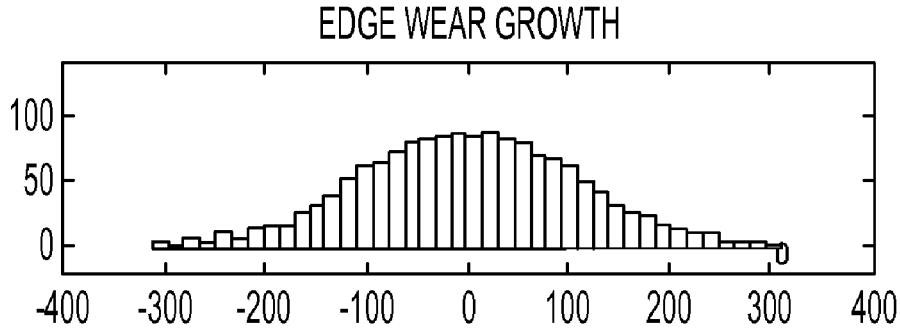

FIG. 8 depicts an exemplary bell-shaped, edge wear growth pattern in the axial direction of a roll produced by using a zig-zag motion pattern for moving the roll in an apparatus including a registration distribution system.

Figure 9:
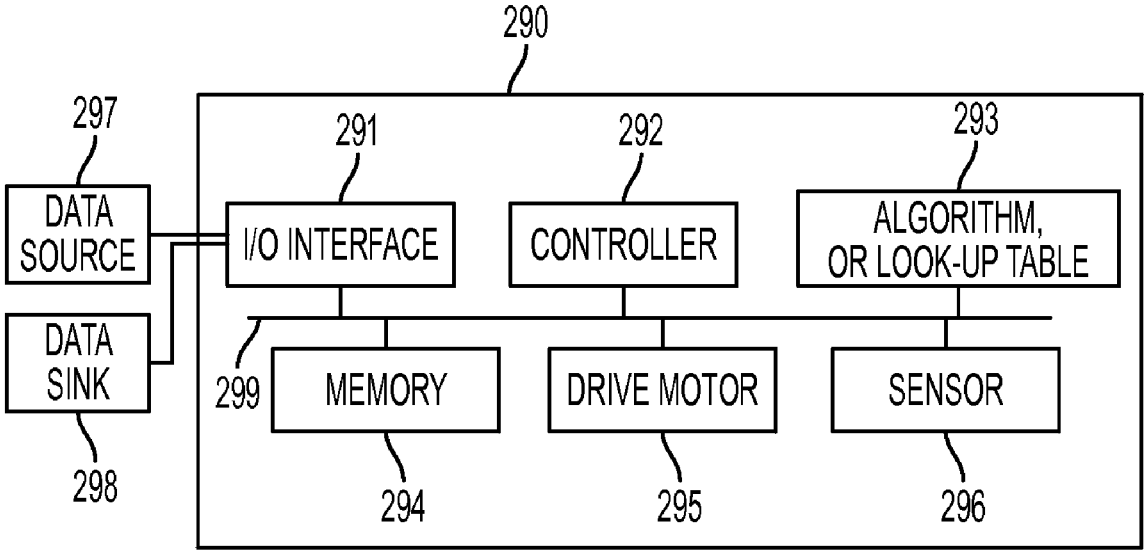

FIG. 9 depicts an exemplary embodiment of a registration distribution system for translating a roll or belt relative to a media path in an apparatus useful for printing.

DETAILED DESCRIPTION

The disclosed embodiments include an apparatus useful for printing comprising a first roll including a first outer surface; a second member including a conformable second outer surface forming a nip with the first outer surface; and a registration distribution system including a motor for translating at least the second member, relative to a medium passing through the nip, in at least a first zig-zag motion pattern from a first home position to a second home position.

The disclosed embodiments further include a fuser comprising a first roll including a first outer surface; a fusing member including a conformable second outer surface forming a nip with the first outer surface; and a registration distribution system including a motor for translating at least the fusing member, relative to a medium passing through the nip, in a first zig-zag motion pattern from a first home position to a second home position.

The disclosed embodiments include a method of mitigating media edge wear effects in an apparatus useful for printing. The method comprises passing a medium through a nip formed between a first outer surface of a first roll and a conformable second outer surface of a second member; and translating at least the second member, relative to the medium passing through the nip, in at least a first zig-zag motion pattern from a first home position to a second home position.

As used herein, the term "printing apparatus" encompasses apparatuses, such as digital copiers, bookmaking machines, multifunction machines, and the like, or portions of such apparatuses, that perform a print outputting function for any purpose. The printing apparatuses can use various types of solid and liquid marking materials, and treat the marking materials using various process conditions to form images on media.

Figure 1:
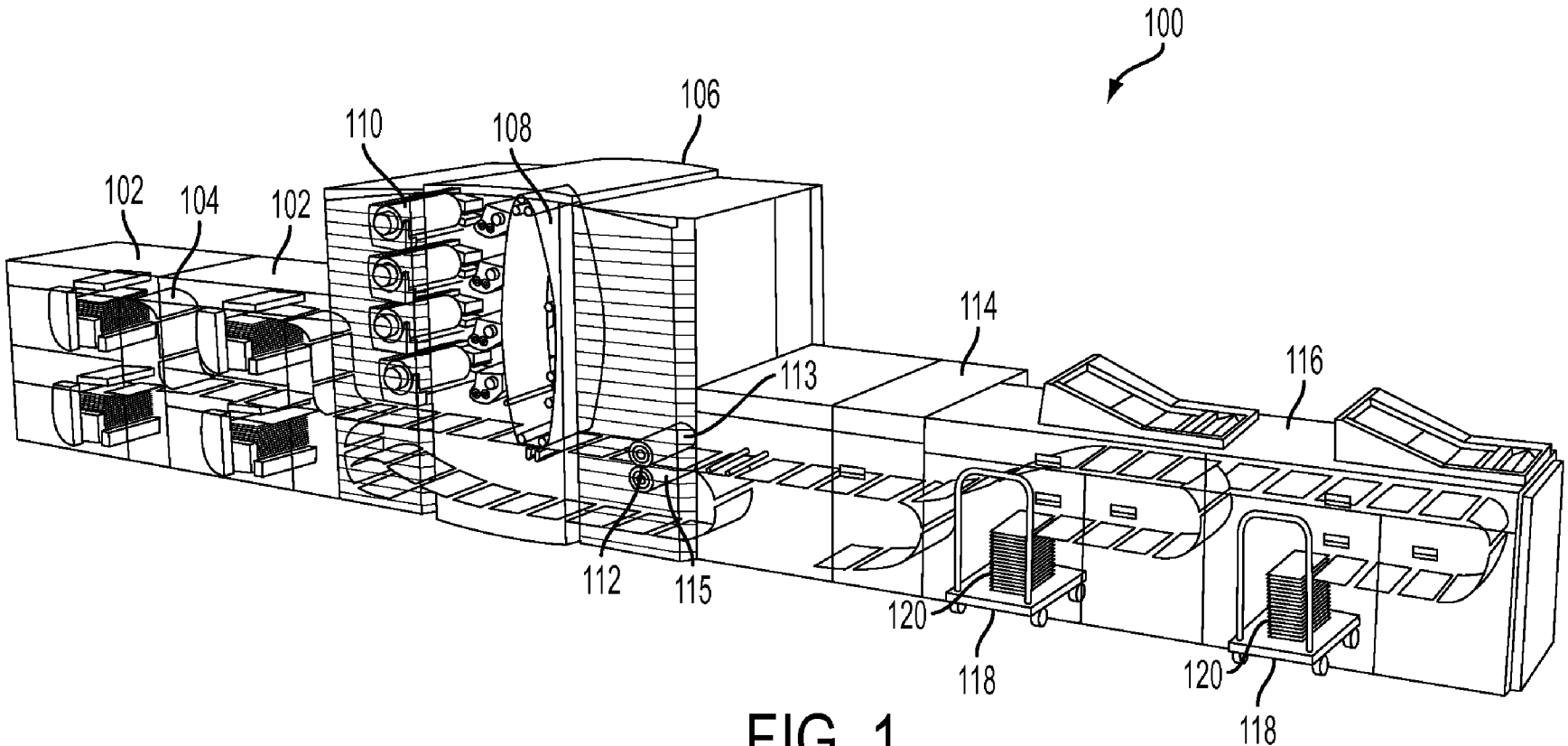
FIG. 1 depicts an exemplary embodiment of a printing apparatus.

FIG. 1 illustrates an exemplary printing apparatus 100, such as disclosed in U.S. Patent Application Publication No. 2008/0037069, which is incorporated herein by reference in its entirety. The printing apparatus 100 can be used to produce prints from various types of media, such as coated or uncoated (plain) paper sheets. The media can have various sizes and weights. In embodiments, the printing apparatus 100 has a modular construction including two media feeder modules 102 arranged in series, a printer module 106 adjacent the media feeding modules 102, an inverter module 114 adjacent the printer module 106, and two stacker modules 116 arranged in series adjacent the inverter module 114.

In the printing apparatus 100, the media feeder modules 102 are adapted to feed media to the printer module 106. In the printer module 106, marking material (toner) is transferred from a series of developer stations 110 to a charged photoreceptor belt 108 to form toner images on the photoreceptor belt and produce color prints. The toner images are transferred to one side of respective media 104 fed through the paper path. The media are advanced through a fuser 112 including opposed rolls 113, 115 forming a nip to fuse the toner images on the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Figure 2:
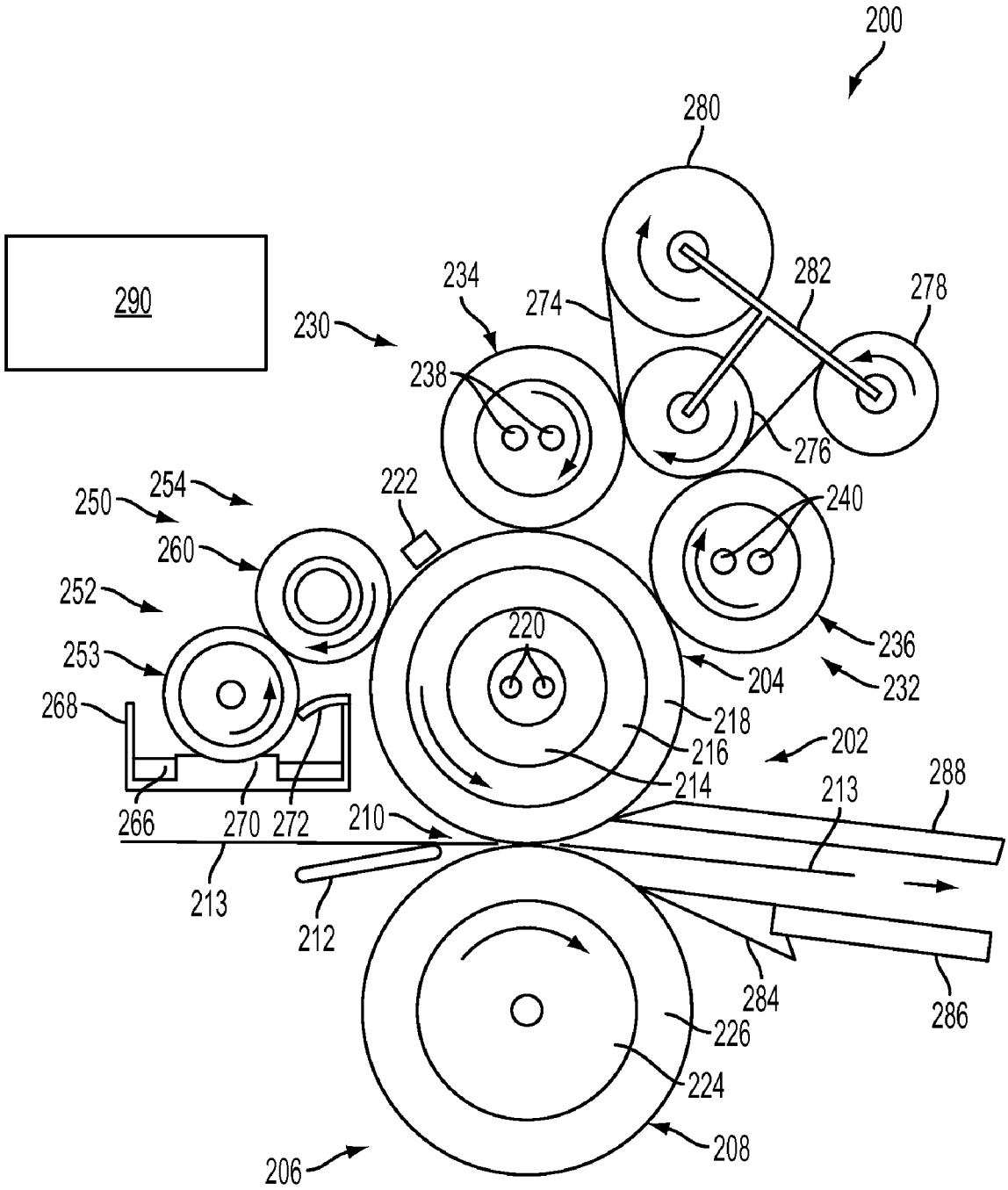
FIG. 2 depicts an exemplary embodiment of an apparatus useful for printing including opposed rolls forming a nip.

FIG. 2 illustrates an exemplary embodiment of the apparatuses useful for printing. The illustrated apparatus is a fuser 200. Embodiments of the fuser 200 can be used in different types of printing apparatuses, e.g., in place of the fuser 112 in the printing apparatus 100 shown in FIG. 1.

The fuser 200 includes a fuser roll 202 having an outer surface 204, a pressure roll 206 having an outer surface 208, and a nip 210 formed by the outer surface 204 and outer surface 208. In embodiments, the fuser roll 202 is driven by a drive mechanism and pressure roll 206 is connected to a cam. The fuser roll 202 and pressure roll 206 rotate in opposite directions, as shown. A guide 212 directs media, such as medium 213, into the nip 210. At the nip 210, the fuser roll 202 and pressure roll 206 apply heat and pressure to media to treat marking material on the media. A medium 213 that has passed through the nip 210 is also shown in FIG. 2.

The fuser roll 202 includes a core 214, an inner layer 216 on core 214, and an outer layer 218 on inner layer 216. In an exemplary embodiment, the core 214 is comprised of aluminum, or the like; the inner layer 216 is comprised of an elastomeric material, such as silicone, or the like; and the outer layer 218 is comprised of a fluoroelastomer sold under the trademark Viton® by DuPont Performance Elastomers, L.L.C., or the like. The outer layer 218 includes the outer surface 204. The outer surface 204 is conformable.

The fuser roll 202 includes one or more heating elements 220 (two are shown) inside the core 214. In embodiments, the heating elements 220 are axially-extending lamps. The heating elements 220 are connected to a power supply (not shown). Two thermistor/thermostats 222 (only one is shown) are positioned at axially-spaced locations along the outer surface 204.

The pressure roll 206 includes a core 224, and an outer layer 226 on the core 224. In an exemplary embodiment, the core 224 is comprised of aluminum or the like, and the outer layer 226 of a perfluoroalkoxy (PFA) copolymer resin or the like.

The fuser 200 further includes external heating rolls 230, 232 having outer surfaces 234, 236, respectively, contacting the outer surface 204 of fuser roll 202. The heating rolls 230, 232 can be comprised of anodized aluminum, or the like. Heating elements 238, 240, such as axially-extending lamps, are located inside of the respective heating rolls 230, 232 to heat the outer surface 204 of pressure roll 202.

A liquid supply system 250 is adjacent the fuser roll 202. The liquid supply system 250 supplies a liquid release agent to the outer surface 204 of fuser roll 202. The release agent can be e.g., a silicon-based organic polymers, or the like. The liquid supply system 250 includes a metering roll 252 and donor roll 254. The metering roll 252 includes an outer surface 253 and the donor roll 254 includes an outer surface 260. The metering roll 252 contacts liquid release agent 266 contained in a sump 268. A wick 270 is provided in the sump 268. The metering roll 252 and donor roll 254 convey the release agent 266 from the sump 268 to the metering roll 252, from the metering roll 252 to the donor roll 254, and from the donor roll 254 to the outer surface 204 of fuser roll 202. A metering blade 272 meters the supply of the release agent to the donor roll 254. The release agent promotes release of media and marking material from the outer surface 204.

The fuser 200 further includes a cleaning web 274 supported on a web nip roll 276. The web nip roll 276 is connected to a web supply roll 278 and a web take-up roll 280 by a frame 282. The cleaning web 274 is unwound from the web supply roll 278 and taken-up on the driven web take-up roll 280. The cleaning web 274 cleans the outer surfaces of the heating rolls 234, 236.

As shown, the fuser further includes a stripper finger 284 and a baffle 286, and an air knife 288, for separating media carrying toner and release agent from the outer surface 204.

As shown, the fuser 200 further includes a stripper finger 284 and a baffle 286, and an air knife 288, for separating media from the outer surface 204 of fuser roll 202.

Figure 3:
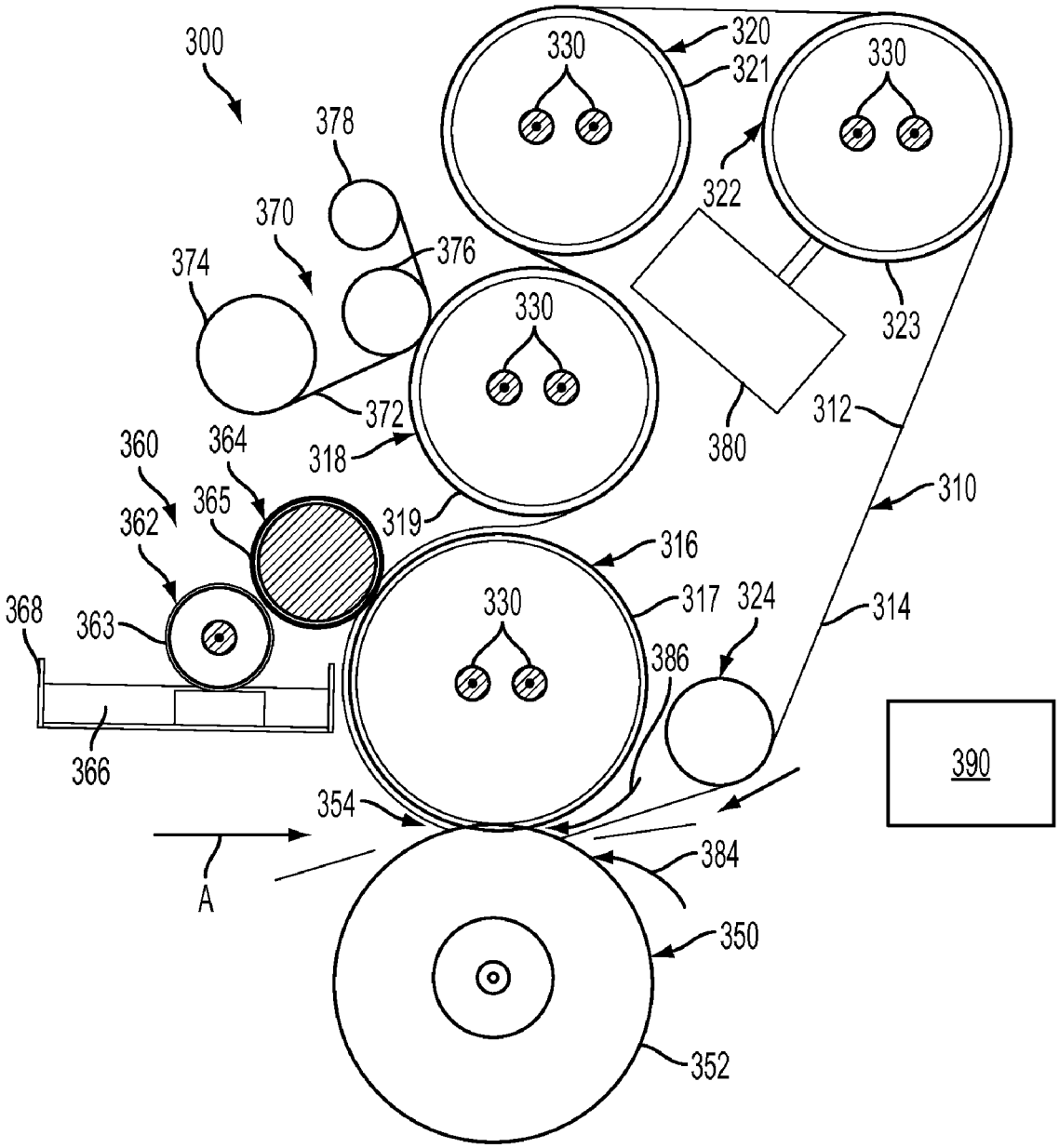
FIG. 3 depicts another exemplary embodiment of an apparatus useful for printing including a belt and roll forming a nip.

FIG. 3 illustrates another exemplary embodiment of a fuser 300 useful for printing. Embodiments of the fuser 300 can be used in different types of printing apparatuses. The fuser 300 includes a continuous belt 310 having an inner surface 312 and an outer surface 314. An exemplary embodiment of the belt 310 comprises a base layer of polyimide, or like polymer; an intermediate layer of silicone, or the like, on the base layer; and an outer layer comprised of a fluoroelastomer sold under the trademark Viton® by DuPont Performance Elastomers, L.L.C., or a like polymer, on the intermediate layer. The base layer forms the inner surface 312 of the belt 310, and the outer layer forms the outer surface 314. The outer surface 314 is conformable.

The belt 310 is supported on a fuser roll 316, external roll 318, internal rolls 320, 322 and a tension control roll 324. The fuser roll 316, internal rolls 320, 322 and tension control roll 324 include respective outer surfaces 317, 321, 323 contacting the inner surface 312 of belt 310, and the external roll 318 includes an outer surface 319 contacting the outer surface 314 of the belt 310.

The belt 310 is heated by the supporting rolls. In embodiments, the fuser roll 316, external roll 318 and internal rolls 320, 322 can each include an internal heat source to supply heat to the belt 310, as shown. In embodiments, the heat sources are axially-extending heating lamps 330. The heating lamps 330 are actuated to heat the belt 310 to a temperature effective to treat marking material on media.

A steering mechanism 380 is coupled to the internal roll 322.

The fuser 300 further includes an external pressure roll 350 with an outer surface 352. The outer surface 352 and the outer surface 314 of belt 310 form a nip 354. Media are fed to the nip 354 in the process direction as indicated by arrow A.

The fuser 300 further includes a release agent supply system 360 for supplying a release agent to the outer surface 314 of belt 310 upstream of nip 354. The supply system 360 includes a metering roll 362 and a donor roll 364. The metering roll 362 includes an outer surface 363 and the donor roll 364 includes an outer surface 365. The metering roll 362 contacts a liquid release agent 366 contained in a sump 368. The metering roll 362 and donor roll 364 convey the release agent 366 from the sump 368 to the metering roll 362, from the metering roll 362 to the donor roll 364, and from the donor roll 364 to the outer surface 314 of belt 310.

The fuser 300 further includes a cleaning web assembly 370 for cleaning the outer surface 319 of external roll 318. The cleaning web assembly 370 includes cleaning web 372 which is supported on a web supply roll 378, a web take-up roll 374 and nip roll 376.

The 300 further includes a stripper finger 384 and an air knife 386 for separating media from the outer surface 314 of belt 310.

A belt steering mechanism 380 is operatively coupled to the internal roll 322. The belt steering mechanism 380 includes a drive mechanism adapted to steer the belt 310 axially with respect to the internal roll 322, and the fuser roll 316, external roll 318 and internal roll 320.

Figure 4:
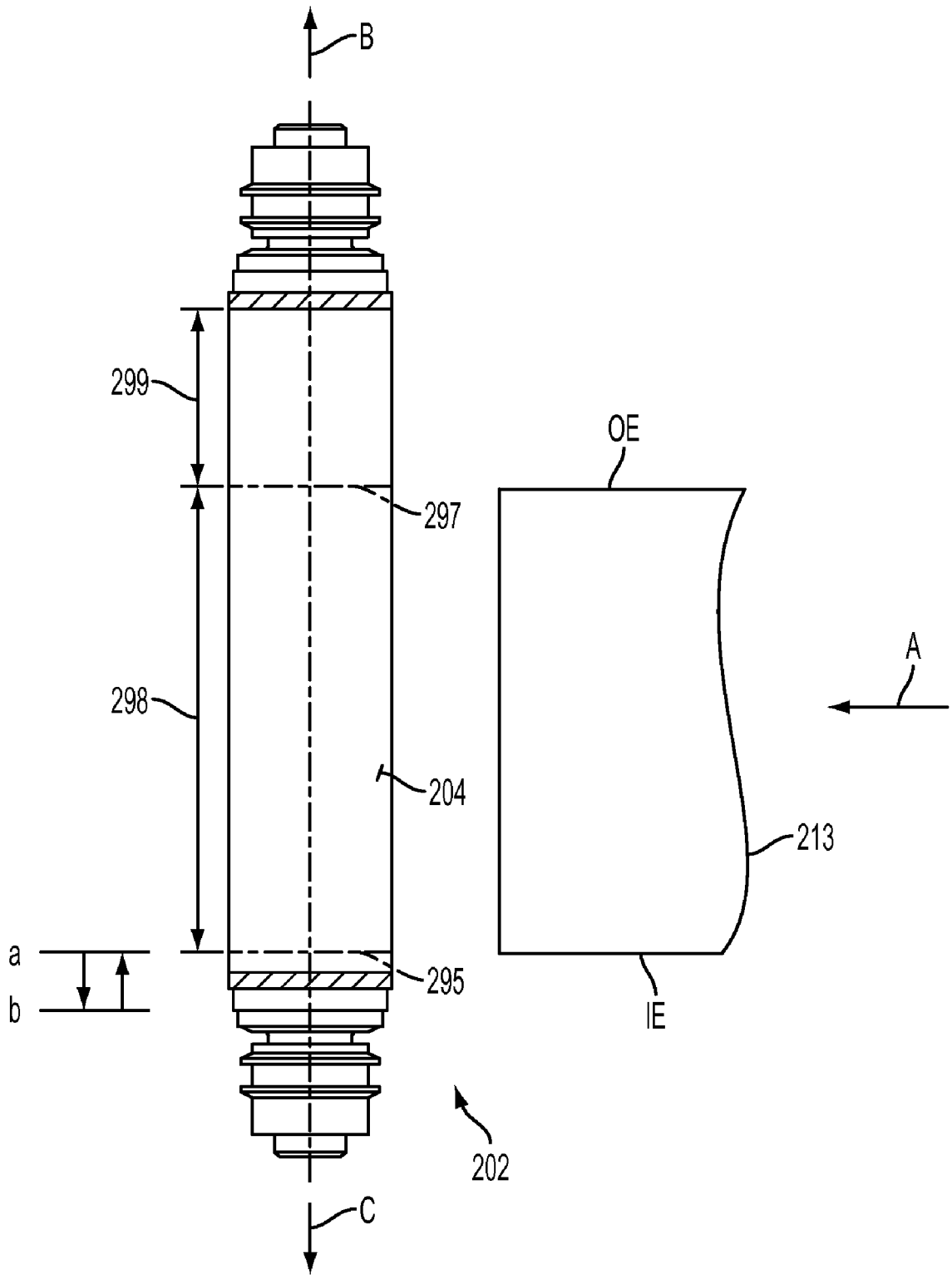
FIG. 4 depicts an exemplary embodiment of a roll of the apparatus shown in FIG. 2.

FIG. 4 depicts an exemplary embodiment of the fuser roll 202 of the fuser 200 shown in FIG. 2. FIG. 4 shows the locations of media registration edge 295, outer edge 297, inside media path length 298 and outside media path length 299 of roll 202. The inside media path length 298 corresponds to the width of the medium 213 having an inner edge IE registered at the media registration edge 295 and an outer edge OE positioned at outer edge 297 with respect to the outer surface 204. The outside media path of the fusing surface 204 is not contacted by the medium 213 registered at the media registration edge 295. For media registered at the media registration edge 295, the location of the outer edge 297 varies for different media widths.

When the medium 213 is fed through the nip 210 of the fuser 200, the pressure roll 206 applies pressure to the fuser roll 202. Pressure acts at the inner edge IE of the medium 213 positioned at the media registration edge 295 and at the outer edge OE of the medium 213 positioned at the outer edge 297 of the inside media path length 298. This pressure produces mechanical strain on the outer layer of the fuser roll 202. Consequently, the outer layer can be abraded at the locations of the media registration edge 295 and/or outer edge 297 at which the respective edges IE and OE of the medium 213 contact the fusing surface 204 of the fuser roll 202. An elastomeric layer under the outer layer can also be degraded. This abrasion can produce edge wear in the outer surface 204 at the media registration edge and outer edge. Such edge wear is typically the dominant failure mode for nip-forming fuser rolls, such as the fuser roll 202. Edge wear also causes differential gloss artifacts in images formed on media when such surface defects in the outer surface 204 are transferred to the media, thereby reducing print quality.

It is noted that such edge wear also occurs in belts in belt roll fusers, such as the fuser 300 depicted in FIG. 3.

To mitigate the severity of edge wear in such nip-forming fuser rolls, the fuser assembly including the fuser roll and pressure roll can be translated axially between maximum travel positions using a registration distribution system (RDS) as disclosed in U.S. Pat. No. 7,013,107, which is incorporated herein by reference in its entirety.

In registration distribution systems including a drive motor that stops and reverses direction when a maximum travel position is reached, backlash may occur in the drive system during the stopping and reversing of direction by the drive motor. For example, in registration distribution systems including a drive motor that moves the fuser assembly continuously from one maximum travel position to the other, there is a dwell period due to drive motor reversal at the end of each travel of the fuser assembly from one maximum travel position to the opposite maximum travel position. Backlash results in loss of motion of the fuser assembly at the maximum travel positions for the dwell period. During each dwell period, extra media pass over the same section of the fuser roll surface before motion of the fuser roll in the opposite direction is resumed. The extra media increase edge wear at the sections of the fuser roll surface.

For example, in the fuser 200, the fuser roll 202 can be translated relative to the fixed path of medium 213 using a registration distribution system. The fuser roll 202 can be translated first in the direction C (FIG. 4) from a first endpoint to a second endpoint, then in the opposite direction D (FIG. 4) from the second endpoint back to the first endpoint, then in the direction C from a first endpoint to a second endpoint, then in the direction D from the second endpoint back to the first endpoint, etc. Using this pattern, the fuser roll 202 is repeatedly moved the same distance in both directions C and D. This movement of the fuser roll 202 is performed to axially distribute the media registration edge position, and the associated edge wear, over the outer surface 204.

However, when the fuser roll 202 is repeatedly translated continuously from the first endpoint to the second endpoint, then from the second endpoint back to the first endpoint, a distinct step profile may be formed on the fuser roll at the first and second travel endpoints. The step profile causes image artifacts to form on media and necessitates early replacement of the fuser roll.

In belt roll fusers, such as the fuser 300, a belt steering mechanism, such as the belt steering mechanism 380, can be used to steer the belt axially in reverse directions to distribute the media registration edge, and the associated edge wear, over the outer surface of the belt. However, a distinct step profile may similarly be formed on the belt when it is moved axially back and forth in a continuous movement between the same two maximum travel positions.

Figure 5:
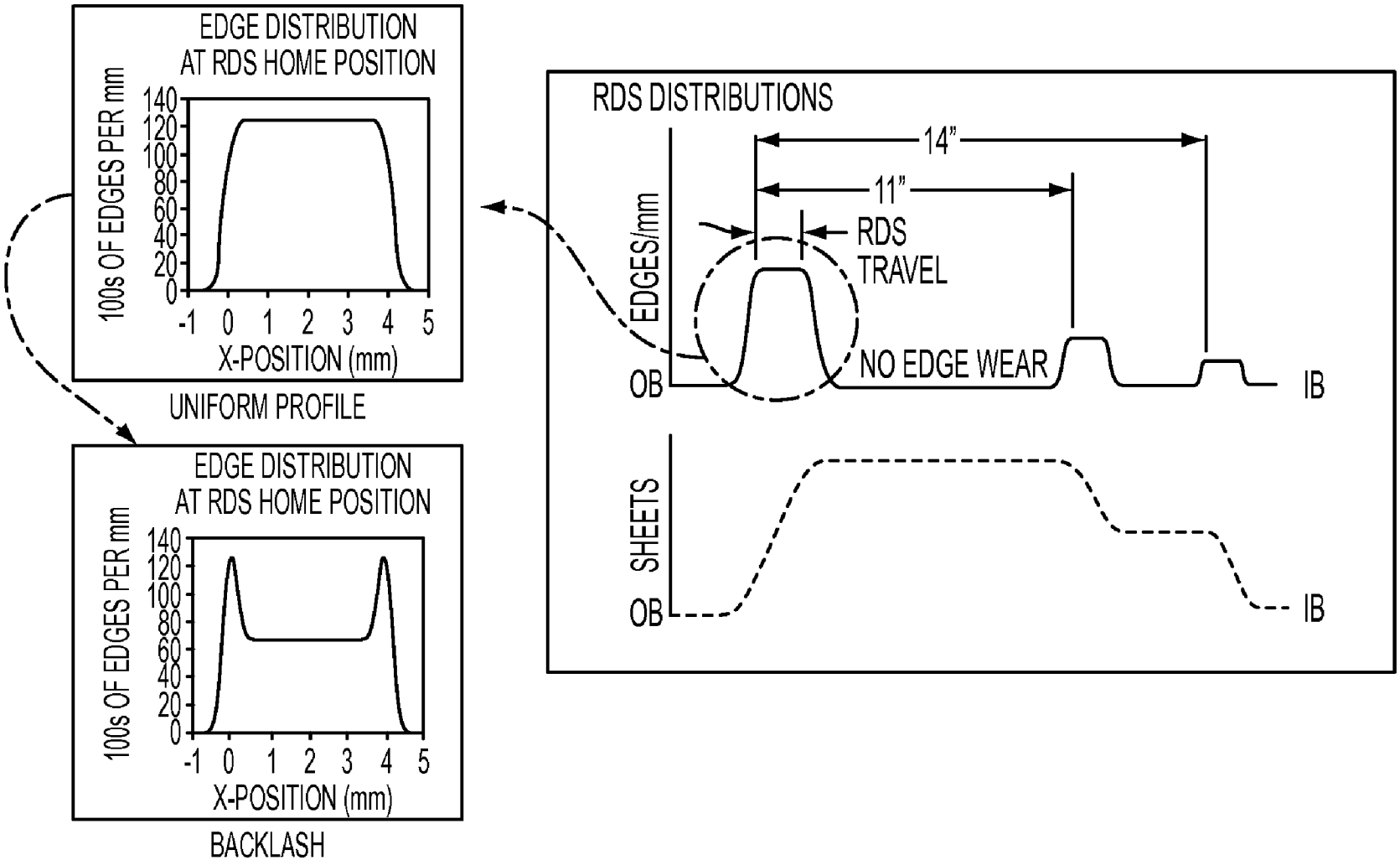
FIG. 5 depicts a wear distribution profile along a roll surface in the axial direction from an outboard edge (OB) to an inboard edge (IB) for 11 inch and 14 inch media in an apparatus including a registration distribution system (RDS), showing a uniform edge wear distribution profile (top left curve) and an edge wear distribution profile with backlash at RDS home positions (bottom left curve).

FIG. 5 depicts an exemplary fuser roll wear distribution pattern as a function of edges/mm and sheets axially along a fuser roll surface in an apparatus including a registration distribution system for 11 inch (279 mm) and 14 inch (356 mm) media. In FIG. 5, "OB" and "IB" indicate the outboard and inboard edges of the fuser roll. FIG. 5 (top left curve) shows an intended uniform media edge distribution profile at registration distribution system home positions (i.e., maximum travel positions of the fuser roll). In this profile, the effects of backlash on edge wear are spread out along the axial direction of the outer surface of the fuser roll.

FIG. 5 (bottom left curve) also shows an edge distribution profile at registration distribution system home positions when motor reversal backlash occurs during fuser roll (or fuser belt) travel resulting from moving the fuser roll (or fuser belt) to the same two end positions during travel). As shown, the backlash produces a higher concentration of paper edges at the ends of the profile corresponding to the maximum travel positions of the fuser roll (or fuser belt). As a result, differential gloss increases significantly when the fuser roll (or fuser belt) is positioned at each end of travel defining the RDS travel zone.

Apparatuses useful for printing that include a registration distribution system adapted to distribute edge contacts of media on the surfaces of rolls and belts to a greater area, to produce smoother edge wear profiles on the surfaces, are provided. In embodiments, the rolls and belts can be fuser rolls and fuser belts (i.e., fusing members) in fusers. The registration distribution systems can mitigate differential gloss artifacts due to motor reversal backlash and extend the useful life of rolls and belts in the apparatuses.

Embodiments of the registration distribution system translate the roll or belt relative to the media path through the nip, which is typically fixed. For example, as shown in FIG. 4, the fuser 200 shown in FIG. 2 can be translated in the axial direction relative to the path of the medium 213 through the nip. In embodiments, the fuser 200 can be in the form of a module, and the entire fuser 200 can be translated with a registration distribution system 290. In other embodiments, at least the fuser roll 202 can be translated. For example, the fuser roll 202 and pressure roll 206 can be translated together in the axial direction.

In embodiment, at least the fuser roll 202 can be translated first in direction C to move a reference position on the fuser roll 202 (e.g., media registration edge 295), or on another member of fuser 200, from point (a) to point (b). The fuser roll 202 is moved when printing is performed in the apparatus, such as when a medium approaching the nip 210 is sensed. Media can be sensed by a media sensor (e.g., an optical sensor) positioned along the media path. Alternatively, media can be sensed with a digital front end, which initiates the printing process and notifies each sub-system that media are arriving. Then, at least the fuser roll 202 can be translated in the reverse direction D to move the reference position from point (b) back to point (a).

In embodiments, the fuser roll 202 is not moved continuously in one direction to move the reference position from point (a) all the way to point (b), or from point (b) to point (a). Rather, the fuser roll 202 is translated in both axial directions to move the reference position from point (a) to point (b), and then translated in both axial directions to move the reference position from point (b) to point (a). The reverse-direction motion pattern of the fuser roll 202 or belt in the axial direction relative to the media path is referred to herein as a "zig-zag" motion pattern.

In other embodiments, the fuser roll 202 can be moved in a zig-zag motion only one way, e.g., between an inboard edge and an outboard edge, or between an outboard edge and an inboard edge. In embodiments, the fuser roll 202 can be moved using more than two zig-zag patterns during print runs. For example, more than two zig-zag motion patterns can be used to move the fuser roll 202 between an inboard edge and an outboard edge, and/or between an outboard edge and an inboard edge.

Figure 6:
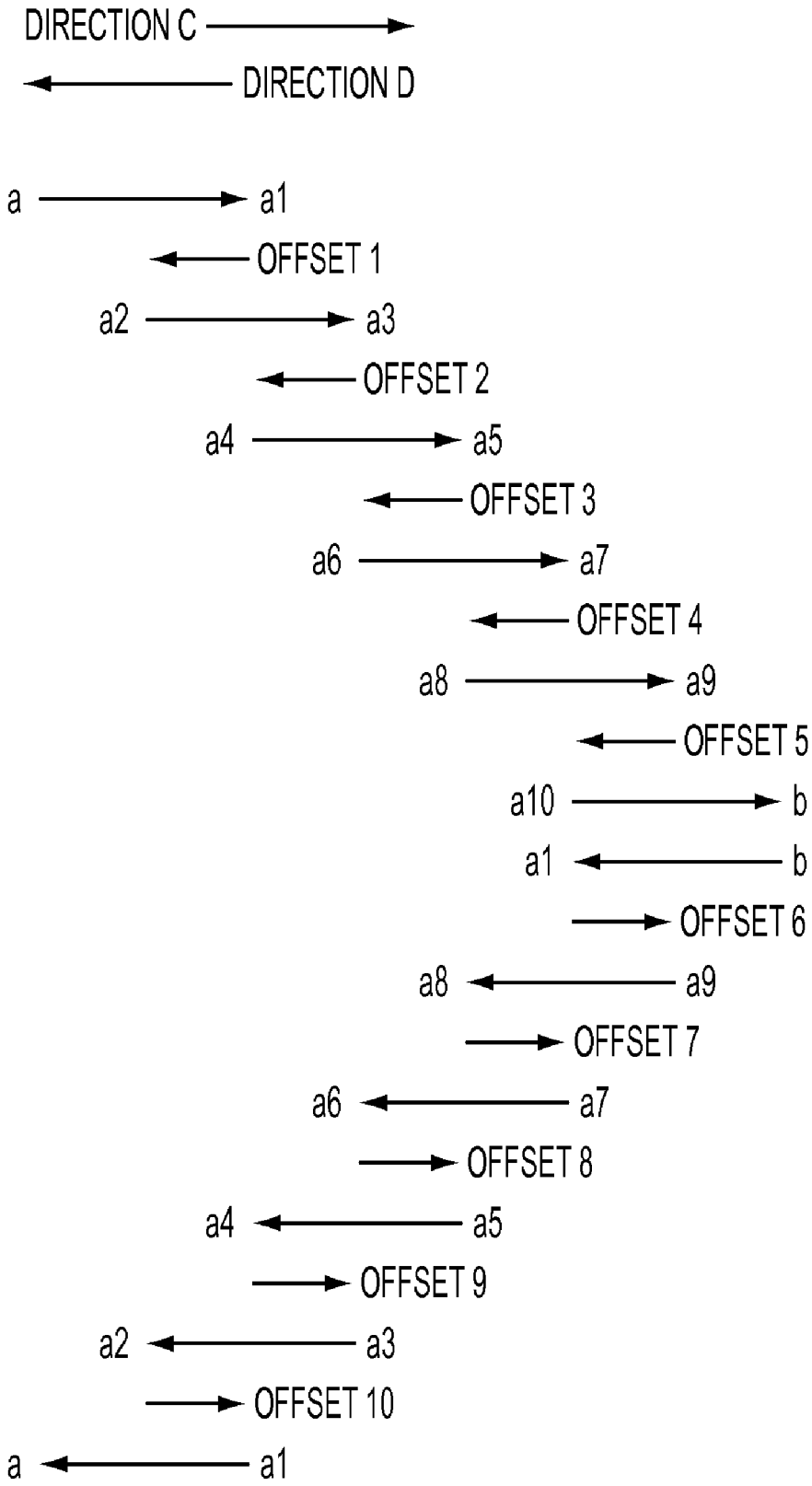
FIG. 6 depicts an exemplary embodiment of a zig-zag motion pattern for moving a roll or belt in an apparatus useful for printing in the axial direction in an apparatus including a registration distribution system.

FIG. 6 depicts an exemplary zig-zag motion pattern that can be used to translate a reference position of the fuser roll 202 from point (a) to point (b), and reversely from point (b) to point (a). As shown, the fuser roll 202 is translated to move the reference position from point (a) to point (b) by making at least one axial translation in each of the directions C and D (multiple translations in each direction are shown), and from point (b) to point (a) by making at least one axial translation in each of the directions C and D (multiple translations in each direction are shown). The axial translations alternate between directions C and D. For example, to move the reference position from point (a) to point (b), the following successive translations are shown: point (a) to point (a1) in direction C, point (a1) to point (a2) in direction D, point (a2) to point (a3) in direction C, point (a3) to point (a4) in direction D, point (a4) to point (a5) in direction C, point (a5) to point (a6) in direction D, point (a6) to point (a7) in direction C, point (a7) to point (a8) in direction D, point (a8) to point (a9) in direction C, point (a9) to point (a10) in direction D, and from point (a10) to point (b) in direction C. Each translation in direction C can have about the same axial length, and each translation ("offset") in direction D can have about the same axial length. The long translations (e.g., from point (a) to point (a1)) can typically have a length equal to about 0.15 to about 0.25, such as about 0.2, of the distance from point (a) to point (b). The offsets can typically have a length equal to about the distance from point (a) to point (a1) minus 1 mm. In embodiments, the time to move from point (a) to point (b) (or from point (b) to point (a)) in a zig-zag motion is typically significantly longer than the time to move between these same points moving in a straight line.

In the exemplary zig-zag motion pattern shown in FIG. 6, the reference point returns to the same home position, i.e., point (a). In other embodiments, the reference point can be returned to a different home position. For example, in a subsequent zig-zag motion pattern, the reference point can be returned to a home position located between points (a) and (a1), and/or to a home position axially spaced from point (b). In embodiments, the axial length of the offsets can be varied to move the endpoints of the reference point in the zig-zag motion patterns. Also, the amount of time that the fuser roll 202 remains at each return point can be reduced by increasing the number of direction changes in translating the reference position from point (a) to point (b), and from point (b) to point (a). In embodiments, the fuser roll 202 is moved continuously between return points, such as between points (a) and (a1). In embodiments, the fuser roll 202 resumes motion from the last run, i.e., the position is not re-set.

By moving the fuser roll 202 in a zig-zag motion pattern relative to the media path, such as using the exemplary pattern shown in FIG. 6, the return points of the fuser roll 202 are moved relative to the media path over time. The total number of return points of the fuser roll 202 in going from point (a) to point (b), and in going from point (b) to point (a) is increased, and the amount of time that the fuser roll 202 remains at each return point can be decreased. By moving the return points in this manner, the effects of backlash on edge wear are reduced. The zig-zag motion can maintain a smooth edge wear profile of the fuser roll while edge wear accumulates, which makes image artifacts less visible.

In belt roll fusers, such as the fuser 300 shown in FIG. 3, the edge wear profile of fuser belts can also be kept smooth while edge wear accumulates by using a zig-zag motion pattern, such as the pattern shown in FIG. 6, for movement of the fuser belt relative to the media path.

In addition to backlash, two other edge wear profile characteristics that can be mitigated by using a registration distribution system are the shape and growth of the edge wear profile. The shape of the edge wear profile is dependent on media history (i.e., types of media run in the apparatus) and uniformity in fuser translation. In embodiments, closed loop control can be used to integrate these two factors with variations of the zig-zag motion pattern to achieve a smoothed edge wear profile. For example, pre-determined information regarding edge wear for different types of media can be used to regulate zig-zag offset and travel distances, to allow different media types, e.g., media weights, to be compensated by the edge density.

In embodiments, feedback control of the zig-zag motion pattern can be used with in-line gloss measurement of media using a gloss meter. In such embodiments, the zig-zag motion pattern can be adjusted, such as by changing the offset length and/or number of return points, to vary the location and/or number of translation endpoints for a roll or belt.

FIG. 7 shows variations of the zig-zag motion that can enhance the smoothness of the edge wear profile. Such variations can include changes in travel speed, zig-zag travel distance and offset.

Regarding the growth of the edge wear profile, edge wear density is proportional to the differential gloss. To make edge wear artifacts less visible on prints, it is desirable to produce a bell-shaped edge wear profile that is smooth throughout the fuser roll (or belt) life. FIG. 8 depicts a simulated desired edge wear growth profile resembling a bell shape as the edge wear accumulates, which results from moving the roll using a zig-zag motion pattern, such as depicted in FIG. 6.

In embodiments, the zig-zag motion pattern used by the registration distribution system can be adjusted based solely on the observed edge wear profile of a roll or belt, without also taking into consideration a characteristic of the media run in the apparatus, such as media weight. For example, the edge wear shape can be observed or measured after a certain number of prints (e.g., 10,000 prints) have been made in the apparatus, and based on the edge wear shape, the zig-zag pattern can be adjusted (e.g., by changing the offset length or RDS speed) to compensate for undesirable aspects of the observed wear profile and produce a profile having a desired shape, such as the bell shape shown in FIG. 8.

In embodiments, the methods of mitigating edge wear of fuser rolls and fuser belts in fusers, as well as other types of rolls or belts in other apparatuses useful for printing, can be integrated in closed-loop edge wear control systems. FIG. 9 depicts an exemplary embodiment of the registration distribution system 290 shown in FIG. 2. The registration distribution system 290 includes a data source 297 connected over a link to an input/output interface 291. A data sink 298 is connected to the input/output interface 291 through a link. Each of the links can be implemented using any known or later developed device or system for connecting the data source 297 and the data sink 298, respectively, to the registration distribution system 290.

The input/output interface 291 inputs data from the data source 297 and outputs data to the data sink 298 via the link. The input/output interface 291 also provides the received data to one or more of a controller 292, memory 294, and an algorithm or look-up table 293. The input/output interface 291 receives data from one or more of the controller 292, memory 294, and/or the algorithm or look-up table 293.

The algorithm or look-up table 293 provides instructions to the controller 292 based on data to smooth the edge wear profile of the fuser roll 202. The controller 292 controls the drive motor 295 to move the fuser 200 according to the instruction sent to the controller 292 by the algorithm or look-up table 293. The algorithm or look-up table 293 may be implemented as a circuit or routine of a suitably programmed general purpose computer.

The memory 294 stores data received from the algorithm or look-up table 293, the controller 292, and/or the input/output interface 291. The memory 294 can also store control routines used by the controller 292 to operate the drive motor 295 to move the fuser 200 according to the algorithm or look-up table 293 upon receipt of a signal from a sensor 296. In embodiments, the sensor 296 detects the location of a reference point of the fuser 200, such as a point on the fuser roll 202, relative to a fixed position, such as one edge of the media path through the nip.

In one exemplary embodiment of the registration distribution system 290, the sensor 296 is tripped by a flag provided on the fuser 200, causing a signal to be sent to the input/output interface 291. The signal is also sent to the memory 294 and the algorithm or look-up table 293 via the bus 299. The instructions for moving the fuser 200 are sent from the algorithm or look-up table 293 to the drive motor 295. The drive motor 295 can be synchronized with the sensor 296 to move the fuser 200 in a zig-zag motion pattern in opposite axial directions, such as depicted in FIG. 6.

As shown in FIG. 3, the fuser 300 includes a registration distribution system 390 operatively coupled to the belt steering mechanism 380 for moving the belt 310 in a zig-zag motion pattern in the axial direction relative to the media path through the nip 354. The registration distribution system 390 can include the same components as the registration distribution system 290, for example. In the axial direction, the belt 310 is moved by steering in addition to the registration distribution system. In embodiments, the registration distribution system is an external drive adapted to move the entire fuser unit including the pressure roll 350.

Although the above description is directed toward fuser apparatuses used in xerographic printing, it will be understood that the teachings and claims herein can be applied to any treatment of marking material on a medium. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions suitable for xerographic fusing.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful for printing, comprising:

a first roll including a first outer surface;

a second member including a conformable second outer surface forming a nip with the first outer surface; and a registration distribution system including a motor for translating at least the second member, relative to a medium passing through the nip, in at least a first zig-zag motion pattern from a first home position to a second home position.

2. The apparatus of claim 1, wherein:

the second member is a second roll including the second outer surface; and the motor translates the second roll in a first axial direction and a second axial direction opposite to the first axial direction during the zig-zag motion pattern.

3. The apparatus of claim 2, wherein the zig-zag motion pattern includes alternating translations in the first axial direction and second axial direction, the translations in the first axial direction are longer than the translations in the second axial direction.

4. The apparatus of claim 1, further comprising at least one sensor connected to the motor to detect a travel position of the second outer surface relative to the medium.

5. The apparatus of claim 1, wherein:

the second member is a belt including the second outer surface; and the motor translates the belt in a first axial direction and a second axial direction opposite to the first axial direction during the zig-zag motion pattern.

6. The apparatus of claim 5, wherein the zig-zag motion pattern includes alternating translations in the first axial direction and second axial direction, the translations in the first axial direction are longer than the translations in the second axial direction.

7. The apparatus of claim 1, wherein:

the zig-zag motion pattern is a first zig-zag motion pattern;

the motor translates at least the second member, relative to a medium passing through the nip, in a second zig-zag motion pattern from the second home position to the first home position; and the second zig-zag motion pattern includes alternating translations in a first axial direction and a second axial direction opposite to the first axial direction, the translations in the first axial direction are longer than the translations in the second axial direction.

8. A fuser, comprising:

a first roll including a first outer surface;

a fusing member including a conformable second outer surface forming a nip with the first outer surface; and a registration distribution system including a motor for translating at least the fusing member, relative to a medium passing through the nip, in at least a first zig-zag motion pattern from a first home position to a second home position.

9. The fuser of claim 8, wherein:

the fusing member is a second roll including the conformable second outer surface and at least one heating element for heating the second outer surface; and the motor translates the second roll in a first axial direction and a second axial direction opposite to the first axial direction during the zig-zag motion pattern.

10. The fuser of claim 9, wherein the zig-zag motion pattern includes alternating translations in the first axial direction and second axial direction, the translations in the first axial direction are longer than the translations in the second axial direction.

11. The fuser of claim 8, wherein:

the fusing member is a belt including the conformable second outer surface;

the belt is supported on rolls adapted to heat the belt; and the motor translates the belt in a first axial direction and a second axial direction opposite to the first axial direction during the zig-zag motion pattern.

12. The fuser of claim 11, wherein the zig-zag motion pattern includes alternating translations in the first axial direction and second axial direction, the translations in the first axial direction are longer than the translations in the second axial direction.

13. The fuser of claim 8, wherein:

the zig-zag motion pattern is a first zig-zag motion pattern;

the motor translates at least the fusing member, relative to a medium passing through the nip, in a second zig-zag motion pattern from the second home position to the first home position; and the second zig-zag motion pattern includes alternating translations in a first axial direction and a second axial direction opposite to the first axial direction.

14. A method of mitigating media edge wear effects in an apparatus useful for printing, comprising:

passing a medium through a nip formed between a first outer surface of a first roll and a conformable second outer surface of a second member; and translating at least the second member, relative to the medium passing through the nip, in at least a zig-zag motion pattern from a first home position to a second home position.

15. The method of claim 14, wherein:

the second member is a second roll including the second outer surface; and the second roll is translated in a first axial direction and a second axial direction opposite to the first axial direction during the first zig-zag motion pattern.

16. The method of claim 14, wherein the zig-zag motion pattern includes alternating translations in the first axial direction and second axial direction, the translations in the first axial direction are longer than translations in the second axial direction.

17. The method of claim 14, further comprising detecting a travel position of the second outer surface relative to the medium.

18. The method of claim 14, wherein:

the second member is a belt including the second outer surface; and the motor translates the belt in a first axial direction and a second axial direction opposite to the first axial direction during the first zig-zag motion pattern.

19. The method of claim 18, wherein the zig-zag motion pattern includes alternating translations in the first axial direction and second axial direction, the translations in the first axial direction are longer than the translations in the second axial direction.

20. The method of claim 14, further comprising:

passing a plurality of media through the nip; and translating at least the second member, relative to each one of the media passing through the nip, in the zig-zag motion pattern from the first home position to the second home position;

wherein an edge wear profile having a bell shape is formed between axially spaced locations on the second outer surface.

21. The method of claim 14, further comprising:

passing a plurality of media through the nip;

translating at least the second member, relative to each one of the media passing through the nip, in the zig-zag motion pattern from the first home position to the second home position;

determining an axial edge wear profile of the second outer surface resulting from passing the plurality of media through the nip; and adjusting at least the zig-zag motion pattern when the determined edge wear profile varies from a desired edge wear profile.

22. The method of claim 21, wherein the desired edge wear profile has a bell shape between axially spaced locations on the second outer surface.

* * * * *